US005284533A

United States Patent [19]

Courbiere et al.

[11] Patent Number: 5,284,533

[45] Date of Patent: Feb. 8, 1994

[54] METHOD FOR THE PREPARATION OF REFERENCE SAMPLES FOR SPECTROGRAPHIC ANALYSIS

[75] Inventors: Michel Courbiere, Tullins; Hubert Dieudonne, Courblevie, both of France

[73] Assignee: Pechiney Recherche, Courbevoie, France

[21] Appl. No.: 870,470

[22] Filed: Apr. 17, 1992

[30] Foreign Application Priority Data

Apr. 26, 1991 [FR] France ..... 91 05768

[51] Int. Cl.[5] ..... C22F 1/04; G01J 3/40

[52] U.S. Cl. ..... 148/550; 148/508; 148/538; 148/689; 148/437; 356/302; 356/311; 356/313

[58] Field of Search ..... 148/550, 538, 689, 437, 148/508; 29/527.6; 356/302, 311, 313

[56] References Cited

U.S. PATENT DOCUMENTS 4,995,920 2/1991 Faure et al. ..... 148/550

FOREIGN PATENT DOCUMENTS 0119036 9/1984 European Pat. Off. .

1472939 5/1977 United Kingdom .

OTHER PUBLICATIONS

Journal of Materials Science, vol. 25, No. 28, Feb. 90, pp. 1381–1391, "Characteristics of Rapidly Solidified Al-Si-X Performs Produced by the Osprey Process", Estrada et al.

Patent Abstracts of Japan, vol. 14, No. 176, (C-707) (4119) Apr. 9, 1990, 63-174799-Kanmeta Eng. K.K.

*Primary Examiner*—R. Dean

*Assistant Examiner*—Robert R. Koehler

*Attorney, Agent, or Firm*—Dennison, Meserole, Pollack & Scheiner

[57] ABSTRACT

A method is disclosed for the preparation of metal reference samples for spectrographic analysis. The method consists of producing a substantially cylindrical preform or blank by spray deposition, followed by the consolidation of the blank in the form of a bar having an appropriate diameter and finally the cutting of the reference samples therefrom. Compared with the prior art methods, the method offers the advantages of an improved chemical homogeneity and low oxygen content.

11 Claims, No Drawings

METHOD FOR THE PREPARATION OF REFERENCE SAMPLES FOR SPECTROGRAPHIC ANALYSIS

The invention relates to a method for the preparation of reference metal samples for spectrographic analysis.

Metal reference samples are generally prepared by conventional casting and crust removal or by powder metallurgy and compacting. They are generally in the form of cylinders, whose machined cross-section is exposed to analysis excitation (spark, X-ray, etc.).

The main quality of these samples is an optimum chemical homogeneity over the entire circular surface. Moreover, as a large number of reference samples is taken from a given product, such as a bar or rod from the same cast billet, it is important that the chemical homogeneity is ensured between the different positions, particularly the top and bottom of the initial bar.

These problems have hitherto partly been solved by the effective use of the central part only of the crust-removed product obtained from a cast billet or by powder metallury. However, in the first case, an elimination by machining of a significant outer part of the cast product leads to a significant gross weight required for making 1000 kg of useful metal and to a high price. In the second case, performance is difficult and expensive (cf. Analytical Chemistry, vol. 49, no. 4, April 1977, p.679). Moreover, in this case, the igniting of the spark is difficult due to the higher oxide content (typically between 2000 and more than 3000 μg/g of oxygen for powder metallurgy as against less than 200 μg/g for spray deposition and typically less than 100 μg/g.

Therefore the method according to the invention consists of producing a substantially cylindrical preform or blank by spray deposition, followed by its consolidation in the form of a bar having an appropriate diameter, followed by the cutting of the reference samples. The term spray deposition is understood to mean a process in which the metal is melted, atomized by a high pressure neutral gas in the form of fine liquid droplets, which are then directed and agglomerated on a substrate in such a way as to form a solid, coherent deposit containing a limited closed porosity. This method is also known as the "Osprey" process. In the case of the invention, the deposit is essentially in the form of billets. Spray deposition preferably takes place under a neutral or mixed gas. The working rate during consolidation must be adequate to make it possible to eliminate the closed porosity induced by the process. Consolidation can be obtained by any known means such as hot extrusion forging, rolling, hammering, etc.

This method has the following advantages compared with the prior art methods:

- it makes it possible to obtain large preforms (e.g. dia. 200×500 mm) having a high chemical homogeneity due to the absence of any major segregation;
- the composition of the alloys can be easily adjusted, particularly the high contents of alloy elements, in the absence of major segregation observed during conventional casting;
- spray deposition under a neutral gas makes it possible to obtain alloys substantially free from oxide inclusions (which is very difficult to avoid in powder metallurgy), even with highly oxidizable elements such as Ti, Li, Na, etc.;
- as stated, it makes it possible to obtain less than 200 μg/g and typically less than 100 μg/g of oxygen.

The invention will be better understood from the following examples relating to Al-based alloys, whose chemical compositions (as a % by weight) are as follows:

| Si | Fe | Cu | Mn | Mg | Cr | Ni | Zn | Sn | Ti | Pb | Ga | Sb | Sr | Cd | Bi | Ca | Na | Zr | In | V | |
|---|---|---|---|---|---|---|---|---|---|---|---|---|---|---|---|---|---|---|---|---|---|
| 0.05 | 0.15 | 0.05 | 0.05 | 5.5 | 0.3 | 0.05 | 8 | 0.3 | 0.25 | 0.8 | 0.04 | | | 0.03 | 0.04 | 0.03 | 0.015 | 0.2 | 0.03 | | (1) |
| 1.5 | 1.5 | 7.5 | 1.7 | 0.05 | 0.05 | 2 | 0.06 | | 0.05 | 0.05 | | 0.05 | | | 0.01 | | | 0.2 | | 0.06 | (2) |

These alloys were obtained in the form of dia. 180×600 mm billets by stray deposition under the following conditions:

| Alloy | (1) | (2) |
|---|---|---|
| Casting temperature: | 720° C. | 750° C. |
| Spacing between atomizer and deposit kept constant during test | 575 mm | 575 mm |
| Gas/metal flow rate ($Nm^3$/kg) | 3.3 | 3.37 |
| Type of gas | $N_2$ | $N_2$ |
| Rotated stainless steel collector | Yes | Yes |
| Oscillation of the atomizer with respect to the rotation axis of the collector | Yes | Yes |

Reheating:
Reheating by induction heating to 420 to 430° C., rise time 5 to 8 min, kept in ventilated furnace (450° C.) from 30 to 80 min.
Hot extrusion
Hot extrusion container temperature 340 to 350° C. extrusion speed $0.9 < v < 4.5$ m/min, extrusion temperature 450° C. and extrusion ratio 11.

For example, the comparative variation coefficients $s/\bar{x}$ of the 3 elements Fe, Cr and Pb, whose contents were determined at different points of the same reference sample and for comparable Fe, Cr and Pb contents and obtained by the 3 indicated methods are respectively:

| | CONTENT IN ALLOY (% by weight) | | | VARIATION COEFFICIENT $s/\bar{x}$ (%) | | |
|---|---|---|---|---|---|---|
| | OSPREY | POWDER METALLURGY | CASTING | OSPREY | POWDER METALLURGY | CASTING |
| Fe | 0.14 | | 0.2 | 0.81 | | 1.00 |
| Cr | 0.35 | 0.15 | | 0.67 | 1.17 | |
| Pb | 0.7 | | 0.8 | 1.19 | | 1.96 |

In this table, s represents the standard variation and $\bar{x}$ the mean value of the content of the considered element. The better chemical homogeneity of the products obtained according to the invention is apparent. Less than 60 μg/g of oxygen was obtained for alloys (1) and (2).

We claim:

1. In a method for spectrographic analysis of an alloy comprising preparing a reference sample of the alloy and exposing said reference sample to analysis excitation, the improvement comprising spray depositing a blank of said alloy with an oxygen content less than 200 μg/g, consolidating said blank in the form of a bar, and cutting a reference sample from said bar.

2. Method according to claim 1, wherein consolidation is by hot extrusion.

3. Method according to either of claims 1 or 2, wherein spray deposition takes place under a neutral or inert gas.

4. Method according to any one of claims 1 or 2, wherein the alloy is an Al-based alloy.

5. Product obtained according to the method of claim 1, wherein the oxygen content of the bar is below 100 μg/g.

6. Method according to claim 3, wherein consolidation is carried out at a working rate adequate to eliminate residual closed porosity.

7. Method according to claim 3, wherein the alloy is an Al-based alloy.

8. Product obtained according to the method of claim 2, wherein the oxygen content of the bar is below 100 μg/g.

9. Product obtained according to the method of claim 4, wherein the oxygen content of the bar is below 100 μg/g.

10. Method according to claim 1, wherein said analysis excitation is x-ray excitation.

11. Method according to claim 1, wherein said analysis excitation is by spark.

* * * * *